US006408608B1

(12) United States Patent
Love et al.

(10) Patent No.: US 6,408,608 B1
(45) Date of Patent: Jun. 25, 2002

(54) THREAD GUIDING WHEELS

(75) Inventors: Peter Brian Love, Stourport-on-Severn; John Davies, Macclesfield, both of (GB)

(73) Assignee: Morgan Advanced Ceramics Limited (GB)

( * ) Notice: Subject to any disclaimer, the term of this patent is extended or adjusted under 35 U.S.C. 154(b) by 0 days.

(21) Appl. No.: 09/446,713

(22) PCT Filed: Jul. 1, 1998

(86) PCT No.: PCT/GB98/01941

§ 371 (c)(1),
(2), (4) Date: Dec. 22, 1999

(87) PCT Pub. No.: WO99/01369

PCT Pub. Date: Jan. 14, 1999

(30) Foreign Application Priority Data

Jul. 2, 1997 (GB) ..... 9714024

(51) Int. Cl.[7] ..... B65H 57/14
(52) U.S. Cl. ..... 57/352; 57/353; 57/357
(58) Field of Search ..... 57/352, 357; 242/155 R; 474/175

(56) References Cited

U.S. PATENT DOCUMENTS

| | | | |
|---|---|---|---|
| 2,642,236 A | | 6/1953 | Heizer |
| 2,802,366 A | | 8/1957 | Borner |

FOREIGN PATENT DOCUMENTS

| | | | |
|---|---|---|---|
| DE | 2522822 | | 12/1975 |
| EP | 0460799 | | 12/1991 |
| EP | 0460799 A1 | * | 12/1991 |
| GB | 294324 | | 7/1928 |
| GB | 0603003 | * | 6/1948 |
| GB | 603003 | | 6/1948 |
| GB | 731298 | | 6/1955 |
| GB | 895467 | | 11/1959 |
| GB | 844806 | | 8/1960 |
| GB | 877176 | | 9/1961 |
| GB | 908112 | | 10/1962 |
| GB | 926772 | | 5/1963 |
| GB | 995667 | | 6/1965 |
| GB | 1 402 752 | | 3/1972 |
| GB | 1297097 | | 11/1972 |
| GB | 2 244 289 A | | 11/1991 |
| GB | 2305980 | | 4/1997 |
| GB | 2 322 385 B | | 2/2000 |
| JP | 06009151 | * | 1/1994 |

OTHER PUBLICATIONS

Search Report issued in Application No. GB 9714024.8.

* cited by examiner

*Primary Examiner*—Danny Worrell
*Assistant Examiner*—Shaun R Hurley
(74) *Attorney, Agent, or Firm*—Dean W. Russell; Kristin D. Mallatt; Kilpatrick Stockton LLP

(57) ABSTRACT

A thread guiding wheel for use in textile machinery has a circumferential slot (8) adapted to receive a given yarn; the circumferential slot is generally V-shaped in section, having axially opposed walls (6, 7) which, in a radially inwards direction, converge to a base at which the walls intersect, the base of the V being sufficiently sharp to grip, between the axially opposed walls, a part of said yarn extending about at least a part of the circumference of the wheel.

12 Claims, 2 Drawing Sheets

THREAD GUIDING WHEELS

This invention relates to thread guiding wheels for use in textile machinery. The invention is applicable both to freely rotating and driven wheels. In the following the terms thread and yarn should be taken as interchangeable.

In textile machinery there are a number of applications that require a thread or yam to be guided over a wheel. One such application is in false twist texturing. In false twist texturing means are provided to heat and then cool a thread or yarn as it passes towards rotating twisting heads.

On a false twist texturing machine it is desirable to position the input feed, nip roller or apron, close to the heater entry to prevent any unsupported yarn length becoming unstable owing to the high yarn rotational speed. Unfortunately, with the increases in processing speed as equipment has improved, the heating and cooling sections of the thread line have become longer resulting in design ergonomic difficulty in fitting the input feed close to the heater entry on the more ideal straight thread line machine.

In a texturing machine thread line where feed system cannot be placed conveniently close to the heater entry it is normally required that a device is positioned at the heater entry to stop the twist passing into the free length of yarn extending upstream from the heater to the entry input feed device. Such devices are called twist stops.

Normal twist stop devices are freely rotating wheels driven by the yarn. These wheels have alternately angled inter-engaging teeth disposed about the circumference of the wheel forming a circumferential slot in which apertures in one wall of the slot receive the base of a tooth extending from the other wall of the slot. In such arrangements the yarn takes an undulating zigzag path about the teeth forcing high pressure between the teeth peaks and the yarn. This pressure stops the yam rotation. The surface finish of the peaks of these teeth is extremely critical if filament damage is to be avoided particularly with multi- and fine filament yams. For example, GB Patent No. 908112, describes a rotatable disc having at its periphery a series of radial slits whereby oppositely bent blades form a zigzag V shaped groove in which the yarn runs. Similarly in GB Patent No. 603003 a V-shaped groove is used having a series of spaced depressions or openings to obtain sufficient grip on the yarn. A similar device is shown in GB Registered Design number 895467, comprising a pair of coaxial secured discs with formed-out ribs between cut-outs on each disc, the ribs on each disc meshing with the cut outs of the other disc.

Twist stops of this type however tend to abrade the yarn filaments or even break the yarn. If a yam breaks it can wrap and get trapped in the twist stop. This can result in distortion of the twist stop during wrap removal by the machine operator so that the twist stop ceases to be an effective twist stop. To reduce these problems the ribs may be stand proud of a disc without slits or cut-outs, as described in GB Patent Number 1297097. Such ribs, or lugs, may be rounded in cross-section so as to provide for more gentle control than with the twist stops previously described. There are however difficulties in producing parts with identical ribs as regard to dimension and surface finish, not only from one twist stop to another, but also around the periphery of a single twist stop so failing to satisfactorily control the yarn sufficiently in this sensitive area. The abrading action of the yarn also wears parts rapidly because of the high contacting pressure on the teeth of the device.

Devices similar to that described above have been made in ceramic materials but it is difficult to achieve the necessary surface finish and they are very easily broken in service.

As an alternative to the above described twist stop devices there is also known a twist stop comprising of a plurality of cylindrical pins secured the periphery of a roller, which pins are alternately oppositely inclined out of the central plane of the roller to form a V-shaped, zigzag yarn path around the periphery of the twist stop. The pins can be of metal or ceramic materials, but if made in metal they are easily cut by the abrasive action of the yarn and if they are made of ceramic they are fragile and easily broken by the machine operator.

The present applicants have realised that the present complex wheels can be replaced by a simple device that is usable both for twist stops and, when used as driven wheels, as textile yam feeds.

Wheels are known which have a generally U-shaped circumferential slot in which a thread is free to move laterally in the base of the U. U.S. Pat. No. 2,642,236 discloses a yarn tensioning device in which a yarn passes over a braked pulley having a generally V-shaped groove but there is no indication that this pulley acts in any way differently from a pulley having a U-shaped groove.

In the present invention a textile machinery thread guiding wheel is provided, the wheel having a circumferential slot adapted to receive a given yam, characterised in that the circumferential slot is generally V-shaped in section, having axially opposed walls which, in a radially inwards direction, converge to a base at which the walls intersect, the sharpness of the base of the V being sufficient to grip, without additional slits cut-outs lugs or ribs, between the axially opposed walls, a part of said yarn extending about at least a part of the circumference of the wheel.

The verb grip should be taken in its ordinary English sense as meaning "to hold firmly or grasp".

Preferably the thread guiding wheel comprises a pair of discs, the V-shaped slot being formed by opposed surfaces at the periphery of the discs.

The V-shaped slot may be formed by the intersection of a substantially flat surface with a curved surface. The flat surface may be on a first disc and the curved surface on a second disc. The curved surface may be substantially frusto-conical.

Advantageously at least a pair of radial slots are provided intersecting the base of the V-shaped slot.

Further features of the invention will be apparent from the claims in the light of the following example with reference to the drawings in which:

Figure 1:
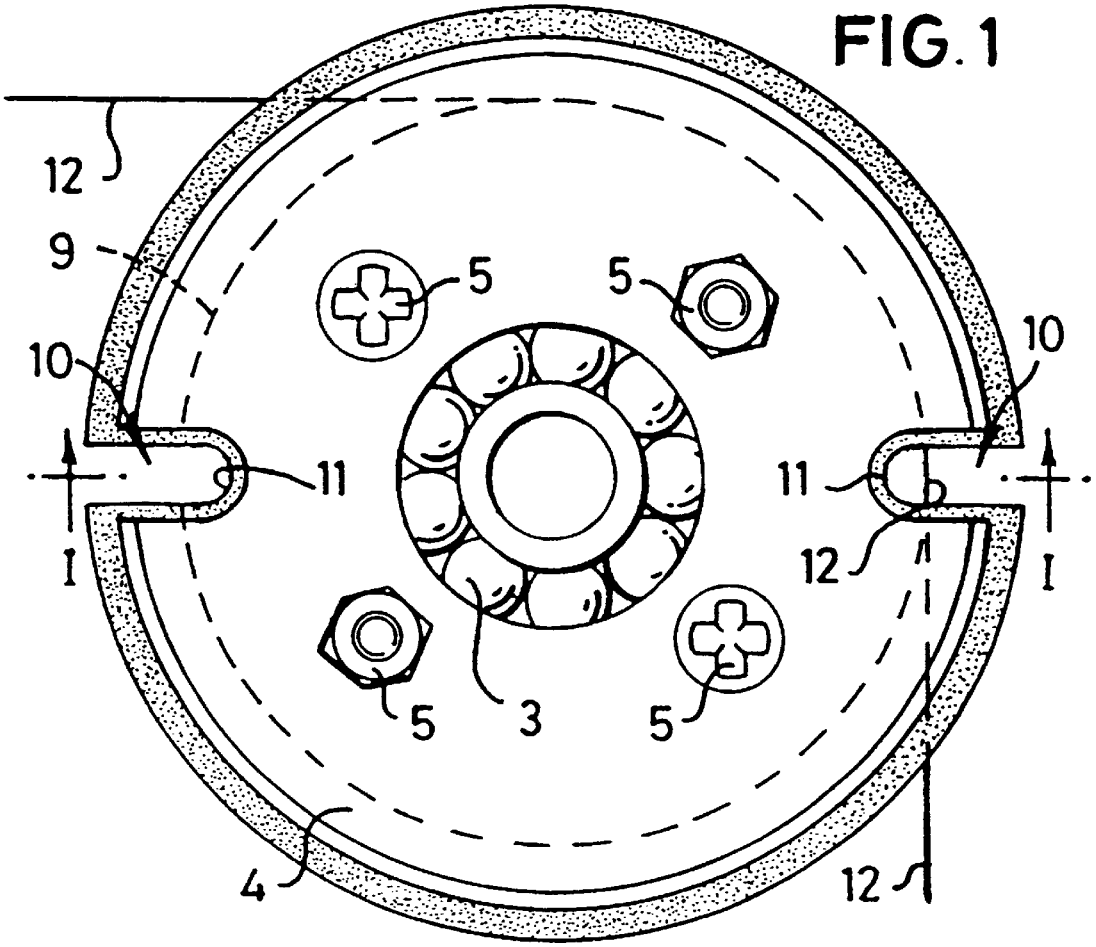
FIG. 1 is a view of a thread guiding wheel in accordance with the invention
Figure 2:
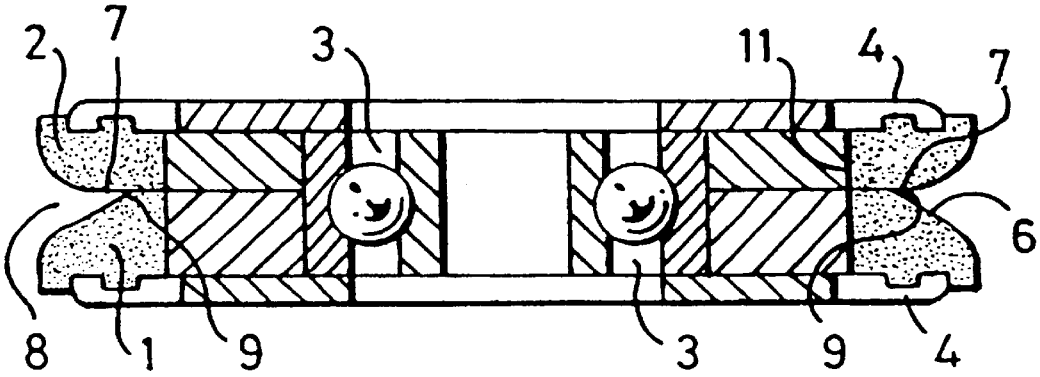
FIG. 2 is a section of the thread guiding wheel of FIG. 1 on the line I—I
Figure 4:
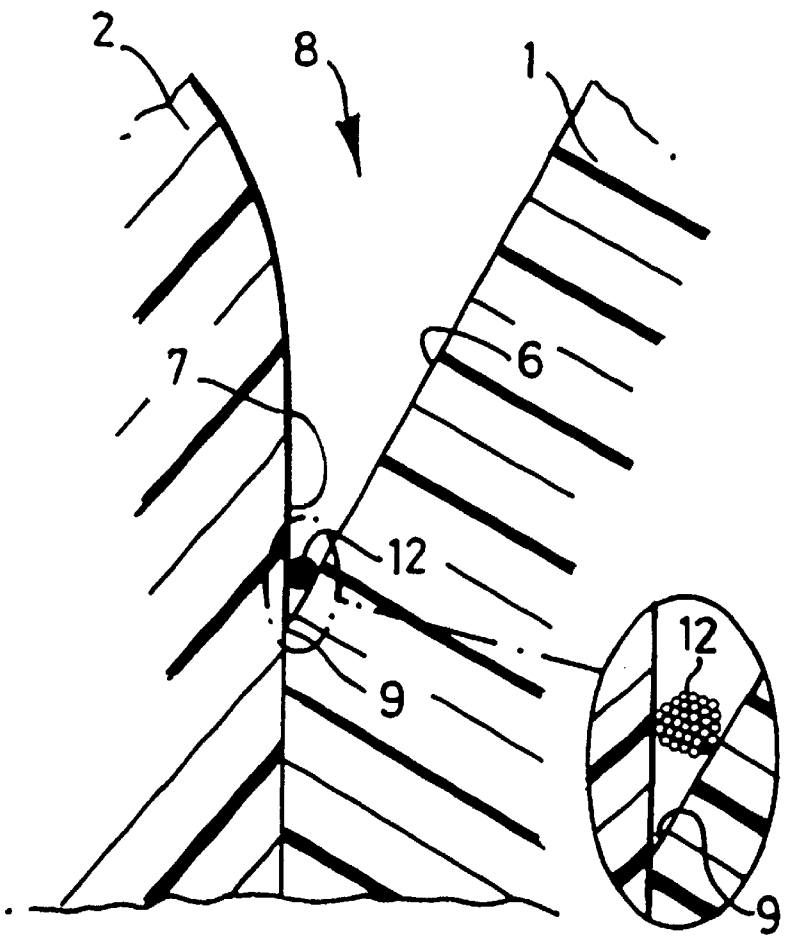
FIG. 4 is a magnified schematic view with further magnified insert showing a thread on the point of leaving the thread guiding wheel of FIGS. 1 and 2

A pair of discs 1,2 are formed from ceramic such as tungsten carbide or alumina although other materials such as sapphire, hardened steels, nitrided steels, or ceramic coated metals may be used. For example, if ceramic is used, suitable materials may be obtained from Morgan Matroc Limited, of Stourport-on-Severn, England and include alumina grade TG12™, a white 99.5% pure alumina; alumina grade Hilox 961™, a brown 96% pure alumina; and zirconia grade Z500™.

The discs 1,2 are mounted on a bearing 3 so that the assembled wheel may be mounted for free rotation on a shaft (not shown). The discs 1 and 2 have reinforcement plates 4 to protect them against damage. The reinforcement plates 4 act as a hub to retain the bearing 3. The assembly of discs 1,2, bearing 3, and reinforcement plates 4, is secured together by nuts and bolts 5 although any other securing means (e.g. rivets, screws, or adhesives) may freely be used. For use as a twist stop the device may be comparatively small, such as up to 50 mm diameter, for example about 30 mm diameter.

Disc I has a generally frusto-conical surface 6 at its periphery and disc 2 has an opposed generally flat surface 7 at its periphery. Between them the surfaces 6 and 7 define a V-shaped slot 8, the base of which is defined by the point 9 at which the surfaces 6 and 7 intersect. The asymmetric V-shape resulting is easier to make than a symmetric V-shaped as it is difficult to control the tolerances to manufacture two identical parts to mate precisely to make a symmetric V. It is also difficult to machine down to the dimensions of a thread in a single piece construction. The surface 6 is shown as generally frusto-conical but any curved surface that converges with the flat surface in a radially inwards direction could be used. The particular arrangement shown is meant to be illustrative and not limitative of the invention.

The angle at the base of the V-shaped slot 8 created by the discs 1,2 when assembled can be for example between 20° and 40°, e.g. 30°.

Peripheral radial slots 10 are provided having bases 11 which lie inwards radially of the point 9. These slots assist easy yarn wrap removal in the event of thread breakage. The thread is unsupported in the slot as base 11 lies inwards of point 9 and so a knife or other tool may be inserted in the slot to pull thread out or to cut the thread. The slots should be disposed so that the wheel is balanced and so, if provided, at least two are required.

A thread or yarn can be formed from any number of separate filaments, e.g. from 1 to 200, but typically around 60 filaments are used. Yarn diameters typically range from 0.02 mm to 0.2 mm and the diameters of the individual filaments that form the yam can typically range from 0.001 mm to 1 mm for monofilament yarn. These dimensions are given as examples to illustrate the typical scale of the invention but are not limitative of the invention.

Figure 3:
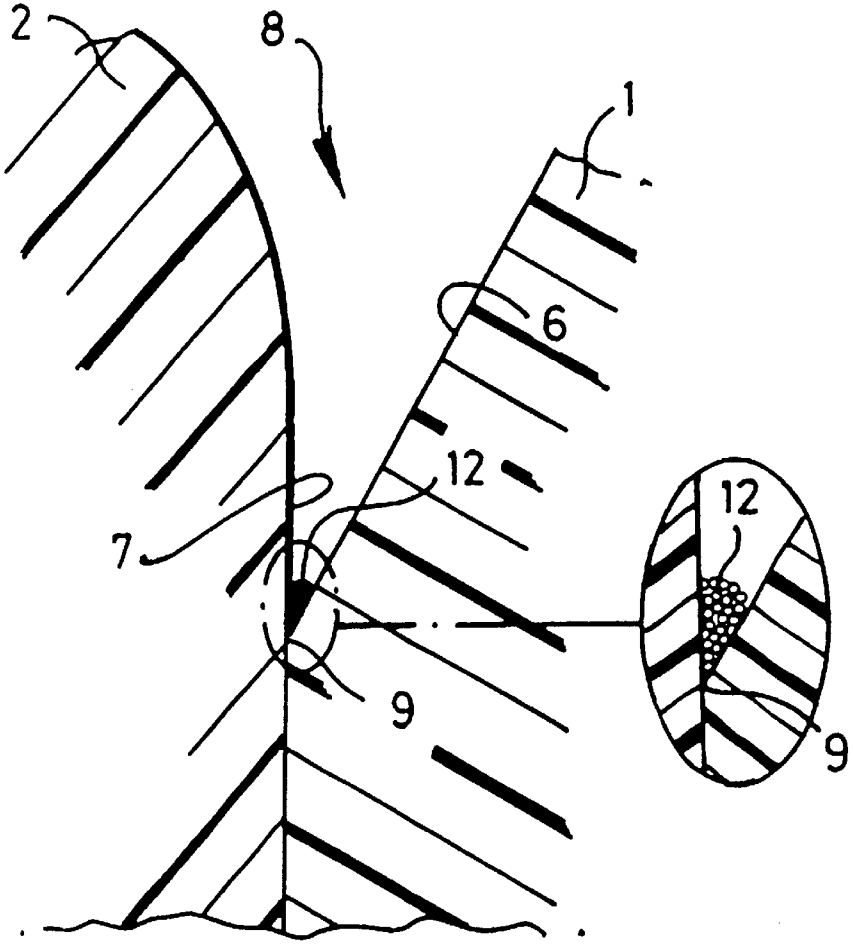
FIG. 3 is a magnified schematic view with further magnified insert showing a thread gripped by the thread guiding wheel of FIGS. 1 and 2

In use a thread 12 passes about at least a part of the circumference of the wheel, e.g. 90°. On approach and departure from the wheel the thread maintains its natural shape but during its passage about the circumference of the wheel the filaments of the thread may configure themselves into the V-shape as shown in FIG. 3. Whether configured or not the thread is pinched between the surfaces 6 and 7 at the base of the V shaped slot which is a sufficiently sharp base to the V so that it is gripped. This gripping prevents passage of twist upstream of the device (twist stop).

This same principal of gripping the thread at the base of a V-shaped slot may be used also in positively driven thread feeds for which purpose the discs 1,2 may be directly mounted on a shaft (omitting the bearing 3) or may be separately driven (for example by a wheel contacting the periphery of the discs). For such applications larger diameters (e.g. 65 mm) may be appropriate.

What is claimed is:

1. A textile machinery thread guiding wheel, the wheel comprising a circumferential slot adapted to receive yarn wherein the circumferential slot is generally V-shaped in section, the V-shape formed by discs wherein (a) a fit disc comprises a substantially flat wall portion and (b) a second disc comprises an at least partially curved surface wall, wherein the substantially flat wall portion of the first disc and the at least partially curved surface wall of the second disc converge to a point at which the walls intersect, the point of the V being sufficient to grip, without yarn gripping structures disposed on the walls, a part of yarn extending about at least a part of the circumference of the wheel.

2. The textile machinery thread guiding wheel as claimed in claim 1 in which the wheel comprises a pair of discs, the V-shaped slot being formed by opposed surfaces at the periphery of the discs.

3. The textile machinery thread guiding wheel as claimed in claim 1, in which the V-shaped slot further comprises intersection on of a substantially flat surface portion extending from the at least partially curved surface wall of the first disc with the substantially flat wall portion of the second disc.

4. The textile machinery thread guiding wheel as claimed in claim 1, wherein each disc has a rounded edge.

5. The textile machinery thread guiding wheel as claimed in claim 3 in which the curved surface is substantially frustoconical.

6. The textile machinery thread guiding wheel as claimed in claim 1 in which the walls intersect at an angle of between about 20° and about 40°.

7. The textile machinery thread guiding wheel as claimed in claim 1 in which at least two radial slots are provided intersecting the base of the V-shaped slot.

8. The textile machinery thread guiding wheel as claimed in claim 1 in which the wheel comprises a bearing.

9. The textile machinery thread guiding wheel as claimed in any preceding claim in which the wheel is adapted to be secured to a driving shaft.

10. The textile machinery thread guiding wheel as claimed in claim 1 in which the walls of the V-shaped slot are formed of ceramic material.

11. The textile machinery thread guiding wheel as claimed in claim 1 for use as a twist stop.

12. The textile machinery thread guiding wheel as claimed in claim 1, for use as a thread driving wheel.

* * * * *